US006057818A

United States Patent [19]

Cole

[11] Patent Number: 6,057,818

[45] Date of Patent: May 2, 2000

[54] LIQUID CRYSTAL DISPLAY DRIVEN BY RAISED COSINE DRIVE SIGNAL

[75] Inventor: James R. Cole, Albany, Oreg.

[73] Assignee: Hewlett-Packard Company, Palo Alto, Calif.

[21] Appl. No.: 09/129,983

[22] Filed: Aug. 5, 1998

[51] Int. Cl.[7] ..... G09G 3/36; G09G 5/00

[52] U.S. Cl. ..... 345/94; 345/100; 345/208; 345/210

[58] Field of Search ..... 345/94, 95, 100, 345/208, 210, 58

[56] References Cited

U.S. PATENT DOCUMENTS

| | | | |
|---|---|---|---|
| 3,991,416 | 11/1976 | Byles et al. | 345/87 |
| 4,485,380 | 11/1984 | Soneda et al. | 345/58 |
| 4,636,789 | 1/1987 | Yamaguchi et al. | 345/208 |
| 4,872,059 | 10/1989 | Shinabe | 348/793 |
| 4,926,168 | 5/1990 | Yamamoto et al. | 345/58 |
| 4,990,905 | 2/1991 | Kuijk | 345/210 |
| 5,247,376 | 9/1993 | Wakai | 345/94 |
| 5,680,147 | 10/1997 | Yamazaki et al. | 345/94 |
| 5,684,501 | 11/1997 | Knapp et al. | 345/94 |
| 5,801,673 | 9/1998 | Shimada et al. | 345/100 |
| 5,805,130 | 9/1998 | Yamamoto et al. | 345/100 |

OTHER PUBLICATIONS

Kaneko et al., "Crosstalk–Free Driving Methods for STN–LCDs" SID 90 Digest; pp. 412–415; 1990.

Mochizuki et al., Elimination of Crostalk in highly Multiplexed STN–LCDs by Using Conducting Orientation Films; SID 90 Digest; pp. 84–87; 1990.

Takeuchi et al., "On the Crosstalk in Direct–Driving of Large Area TN–LCDs" Mol. Cryst. Liq. Cryst. 1981, vol. 66, pp. 83–96; 1981.

Ilcisin, K.J., "P2–10 Adaptive Drive: A New Drive Waveform for Reducing Cross–Talk in Active Matrix Displays;" Japan Display '92; pp. 467–472; 1992.

Maltese, P; "Cross–Modulation and Nonuniformity Reduction in the Addressing of Matrix Displays;" Proceedings of the SID, vol. 26/2, pp. 125–132; 1985.

Scheffer et al., "Active Addressing of STN Displays for High–Performance Video Applications;" Displays, vol. 14, No. 2, pp. 74–85; 1993.

Ruckmongathan et al.; "S3–4 A New Addressing Technique for Fast Responding STN LCDs;" Japan display '92, pp. 65–68, 1992.

Ruckmongathan, T.N.; "S3–7 Addressing Techniques for RMS Responding LCDs—A Review;" Japan Display '92, pp. 77–80, 1992.

*Primary Examiner*—Richard A. Hjerpe
*Assistant Examiner*—Benjamin D. Bowers

[57] ABSTRACT

A drive signal for an LCD panel is formed of pulses having a raised cosine shape. Such pulse shape results in a drive signal having minimal harmonic content. The resulting drive signal is less susceptible to low pass filter, signal degradation effects. Regarding STN displays, the degradations which do occur are readily correctable amplitude and phase variations. Regarding TFT panels, the reduced harmonic content, in turn reduces coupling between adjacent panel circuits.

11 Claims, 6 Drawing Sheets

FIG.3
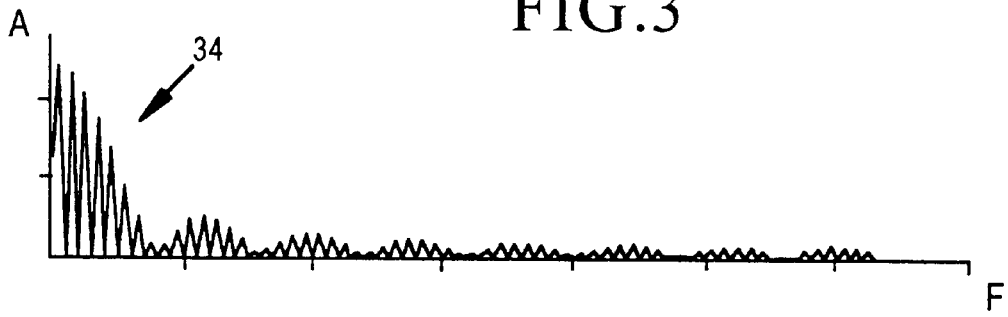
FIG.4
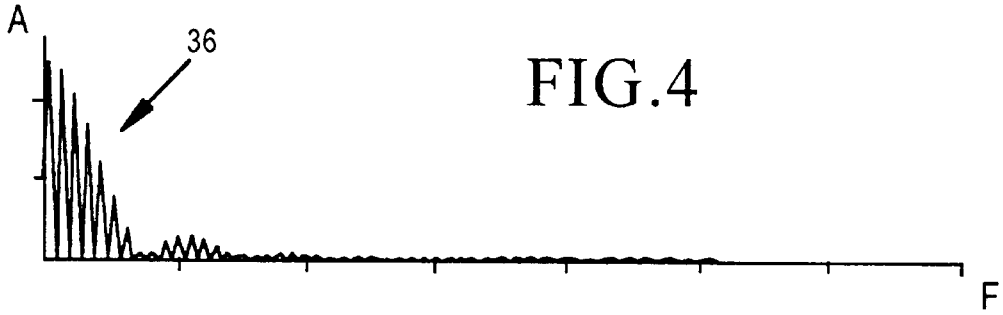
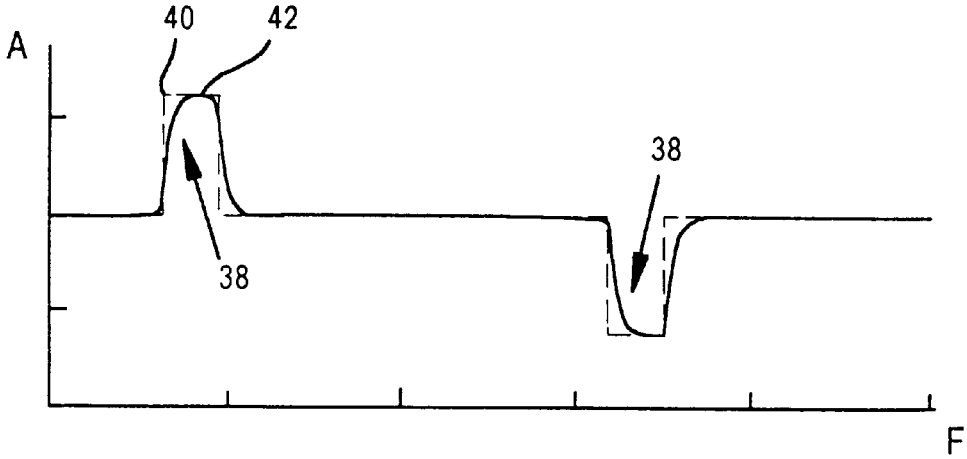
FIG.5

LIQUID CRYSTAL DISPLAY DRIVEN BY RAISED COSINE DRIVE SIGNAL

BACKGROUND OF THE INVENTION

This invention relates generally to liquid crystal display panels, and more particularly, to signal waveforms for driving pixels cells of a liquid crystal display panel.

A liquid crystal display (LCD) generally includes a backplate substrate, a faceplate substrate and a liquid crystal material sealed between the two. Polarizers, colorizing filters and spacers also are included between the substrates. The liquid crystal is an oily substance that flows like a liquid, but has a crystalline order in the arrangement of its molecules. An electrical field is applied to thread-like or nematic liquid crystal molecules which respond by reorienting themselves along electric field lines. Such orientation of the molecules causes light to be polarized along the particular orientation. Polarizers then transmit or block the light depending on the polarization. The backplate typically is a glass substrate on which are formed a horizontal scanning circuit, a vertical scanning circuit and a pixel region. For an active matrix LCD, the glass substrate is essentially a large integrated circuit having thousands or millions of thin-film transistor (TFT) switches. The TFT switches form horizontal and vertical scanning circuits. The TFT switches define respective cells of a pixel region. Each cell serves as a color pixel.

The TFT switches become more densely packed as resolution increases. This increases the probability of coupling between adjacent circuits. In particular, row pulses can couple to a source line, directly affecting the stored voltage level, which in turn affects a resulting gray scale tone. The degree of coupling is dependent on the signal on the drain line. Thus, the degree of gray shift is data-dependent. This results in visible crosstalk artifacts.

Because the coupling between adjacent TFT panel circuits is through a parasitic capacitor, the coupling gets worse at higher frequencies. The rectangular pulses used for the row line selects have significant harmonic content. It is the high frequency energy from the harmonics of the edges which causes the most problems. One solution has been to add components which filter the drive pulse edges to lower the harmonic content. This solution however decreases the performance of the switches at higher resolutions, and consumes additional power. Accordingly, a more effective, less power consumptive solution is needed for avoiding coupling of adjacent panel circuits on a TFT panel.

Alternative LCD displays are formed by passive matrix designs formed with 'super twist nematic' (STN) or 'double super twist nematic' switches. A major distinction between active matrix LCDs and passive matrix LCDs are that passive matrix LCDs do not have a transistor associated with, and located with, each pixel. A matrix of pixels is formed by electrodes arranged in horizontal rows on one plate and vertical columns on the other plate to provide at pixel at each intersection. A limitation of the STN passive matrix LCD panel is its slow response time. This limitation has become more significant as multimedia and graphics applications become more prevalent. To present mid-level colors and gray scale tones the frame rate for an STN panel must be substantially faster than the response time. As STN panel cells are designed to respond faster, the frame rate for refreshing the STN panel is to be faster. The challenge that arises, however, is that as the frame rate increases, the drive pulses of a conventional drive signal become increasingly degraded. This results in visual artifacts.

STN panels are addressed by applying orthogonal waveforms to the panel rows, while driving the panel columns with a linear combination of the row waveforms. In the simplest and most common example, the rows and columns receive rectangular pulses. Ideally, the column signals are a combination of perfectly aligned rectangular pulses. However, as the row pulses get degraded, the column waveforms do not match up as a combination of row pulses.

According to one conventional addressing scheme each row is selected once during an image frame period. In an active addressing scheme each row is selected more than once in a frame period. Because more than one pixel is addressed at the same time and because pixels share a common column line, the state of one pixel can be affected by the state of another pixel. This is referred to as "crosstalk." Because the column signals are image dependent and each column electrode is capacitively coupled to every row electrode, the state of any pixel can impact the state of every other pixel. Crosstalk due to capacitive coupling is referred to as "coupling crosstalk." Visual artifacts, such as image "ghosts" are due to such coupling crosstalk.

The panel's also exhibits RC coupling effects which appear as low pass filtering. As a result, the drive pulses have exponential edges instead of sharp, precise transitions. The time constant for the exponential edges is related to various panel elements, but generally stays constant as the panel refresh rate is increased. As the refresh rate increases, the drive pulses become narrower. With the time constant for the exponential portion staying the same, the exponential portion takes up more and more of the pulse shape as the refresh rate increases. The resulting pulses look less and less ideal, and the resulting crosstalk becomes worse and worse.

Accordingly, there is a need for a method and apparatus for driving an STN panel at increasing frame rates without degradation of the drive signal pulses. Early efforts to address this problem typically involved feedback circuits which monitored the row waveforms and forced them to be rectangular. This solution is costly and inconvenient because sense points are required at the non-driven end of the row trace lines. Such solution also increases power consumption.

Another solution has involved using row pulses which are more complex, but which do not require faster frame rates. A common characteristic of these techniques is that they select more than one row at a time. This means that the drive signal for a column line must be constructed from more than one row of information. Thus, some storage area is required. In at least one implementation, an entire frame of data must be stored on the panel, which greatly increases cost and power consumption. In another implementation two rows are selected at a time, so that the on-panel storage requirements are minimized, but the display quality improvement is less.

SUMMARY OF THE INVENTION

According to the invention, a drive signal for an LCD panel is in a raised cosine pulse shape. An advantage of a raised cosine pulse shape for driving an STN panel is that harmonic content is minimal. Thus, it is less susceptible to low pass filter, signal degradation effects. Raised cosine pulses on various row select lines are linearly combined in the column drivers by selecting appropriate phases of the originating sinusoidal waves. The resulting waveforms have much less harmonic content than other pulse shapes and thus are less susceptible to degradation. In addition, the degradation which does occur are readily correctable amplitude and phase variations.

With regard to TFT panels, raised cosine pulses used on the row lines reduce harmonic content, which in turn reduces coupling between adjacent panel circuits.

An advantage of the raised cosine pulse drive signal waveform is that crosstalk and signal degradation is avoided in an active matrix or passive matrix LCD panel without implementing a power consumptive solution. These and other aspects and advantages of the invention will be better understood by reference to the following detailed description taken in conjunction with the accompanying drawings.

BRIEF DESCRIPTION OF THE DRAWINGS

FIG. 3 is a graph of a frequency spectrum for the rectangular pulse waveform of FIG. 2;

FIG. 4 is a graph of a frequency spectrum for a rectangular pulse waveform exhibiting low-pass filtering effects;

FIG. 5 is a graph of a rectangular pulse waveform having an exponential transition due to low-pass filtering effects;

DESCRIPTION OF SPECIFIC EMBODIMENTS

Passive Matrix Display

Figure 1:
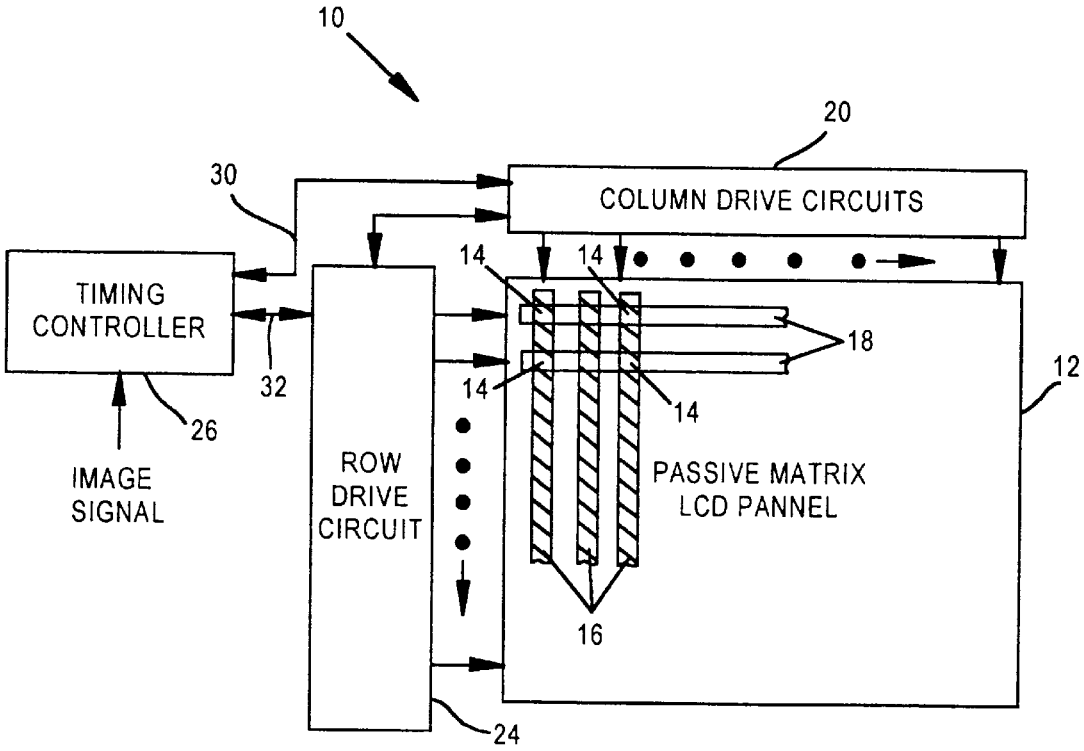
FIG. 1 is a block diagram of a passive matrix LCD display.

FIG. 1 shows a super twist nematic LCD panel 10 including an array 12 of pixel areas 14. Each pixel area 14 is formed by a super twist nematic connection of an overlapping column electrode 16 and row electrode 18. Only a subset of the electrodes 16, 18 are illustrated. A given pixel area 14 is excited to display an image pixel by receiving an active signal along its row electrode 18 and an optical state defining signal along its column electrode 16. The optical state defining signal defines the addressed pixel area 14 to have an 'on' state or an 'off' state. For a monochromatic display panel each pixel "on" state is of the same color. For a color panel there are different colored electrodes 16, 18. For example, a given pixel area 14 may be one of red, green or blue when in the "on" state.

The optical state defining signals are generated by column drive circuits 20. The state of the optical state defining signals is determined from an image signal received at a timing controller 26. The timing controller receives an image signal and controls output of the corresponding image data to the appropriate column drive circuit so as to define the desired state of each pixel area 14 in the display panel. A set of row drive circuits 24 generates drive signals for the row electrodes 18. Timing signals 30, 32 are sent from the timing controller 26 to the column drive circuits 20 and row drive circuits 24 which determine the addressing sequence for activating the various pixel areas 14.

Figure 2:
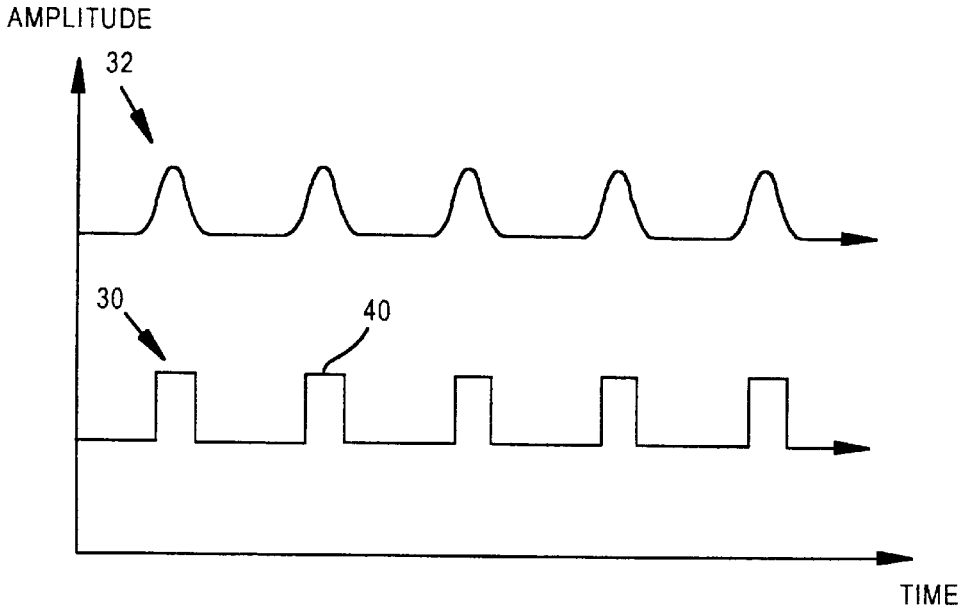
FIG. 2 is a graph of an ideal raised cosine pulse waveform and an ideal rectangular pulse waveform.

Referring to FIG. 2, two waveforms 30, 32 are shown. Waveform 30 is an ideal rectangular pulse waveform. Waveform 32 is an ideal raised-cosine pulse waveform. FIG. 3 shows the ideal rectangular drive pulse frequency spectrum 34. FIG. 4 shows the actual rectangular drive pulse frequency spectrum 36 exhibiting low pass filtering effects. The low pass filtering effects occur when driving the multiple rows and columns of the LCD panel 10 as described in the background section. FIG. 5 shows the actual column optical state defining waveform 37 intended to be a rectangular wave. Note that the pulses are distorted to exhibit an exponential transition 38, rather than a sharp transition 40 as in the ideal waveform 30 of FIG. 2. As the frame rate for displaying an image on the display panel 10 increases, the pulse duration gets smaller. The time constant for the exponential portion 38 however, generally stays constant, even as the frame rate increases. As a result, the width of the exponential portion 38 stays the same and the straight portion 42 is reduced or cut off. Thus, as the frame rate increases, the exhibited degradation appears worse and worse. Correspondingly, the crosstalk visual artifacts get worse.

Figure 6:
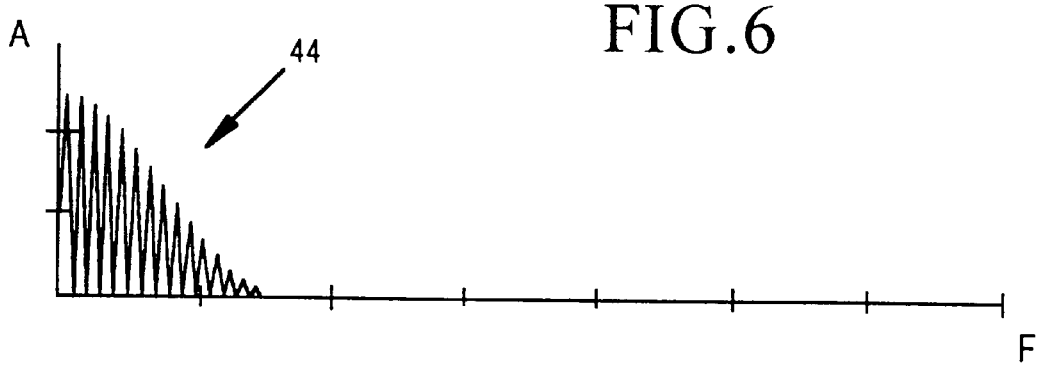
FIG. 6 is a graph of a frequency spectrum for the raised cosine pulse waveform of FIG. 2.
Figure 7:
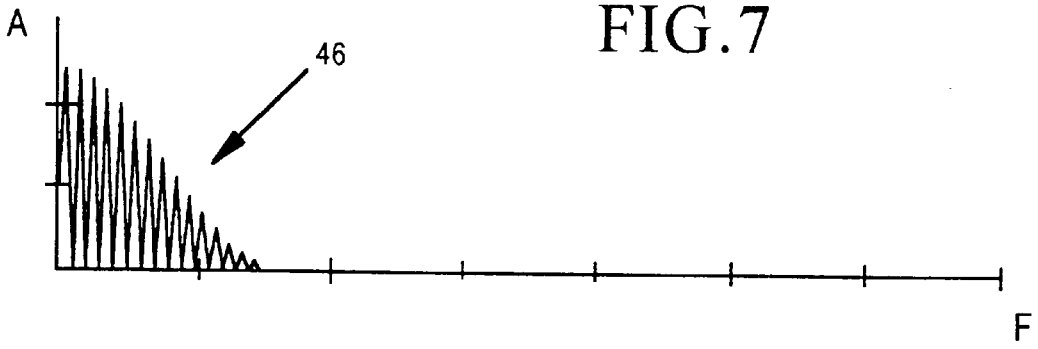
FIG. 7 is a graph of a frequency spectrum for a raised cosine pulse waveform exhibiting low-pass filtering effects.
Figure 8:
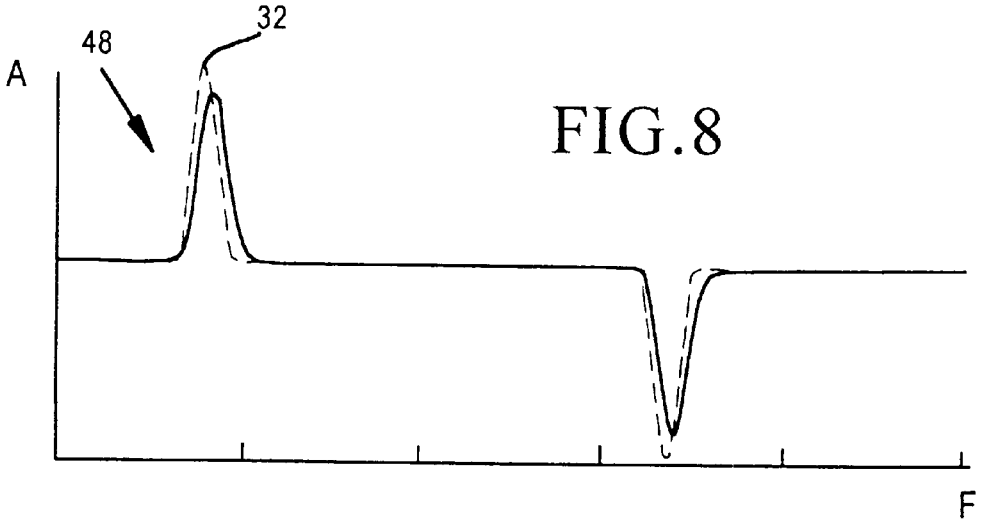
FIG. 8 is a graph of a raised cosine pulse waveform having a phase shift an amplitude reduction due to low-pass filtering effects.

FIG. 6 shows the ideal raised cosine drive pulse frequency spectrum 44. FIG. 7 shows the actual raised cosine drive pulse frequency spectrum 46 exhibiting the low pass filtering effects. FIG. 8 shows the actual raised cosine drive signal 48 received by the column electrodes 16 in the presence of such low pass filtering effects when one row of the display is driven at a time. Note that the effect is merely a slight phase shift and decrease in amplitude. The amplitude degradations are readily correctable using a variable gain amplifier, while the phase shifts are correctable using a phase shift at a phased locked loop circuit. Accordingly, crosstalk effects and signal degradation can be avoided in a passive matrix display by addressing the rows one at a time and using drive signals formed of raised cosine pulses. The better performance of the raised cosine pulses is due to the presence of many fewer harmonics in the raised cosine pulse frequency spectrum compared to the rectangular pulse frequency spectrum and the frequency spectrums of more complex signals now being used as drive signals.

Active Matrix Display

Figure 9:
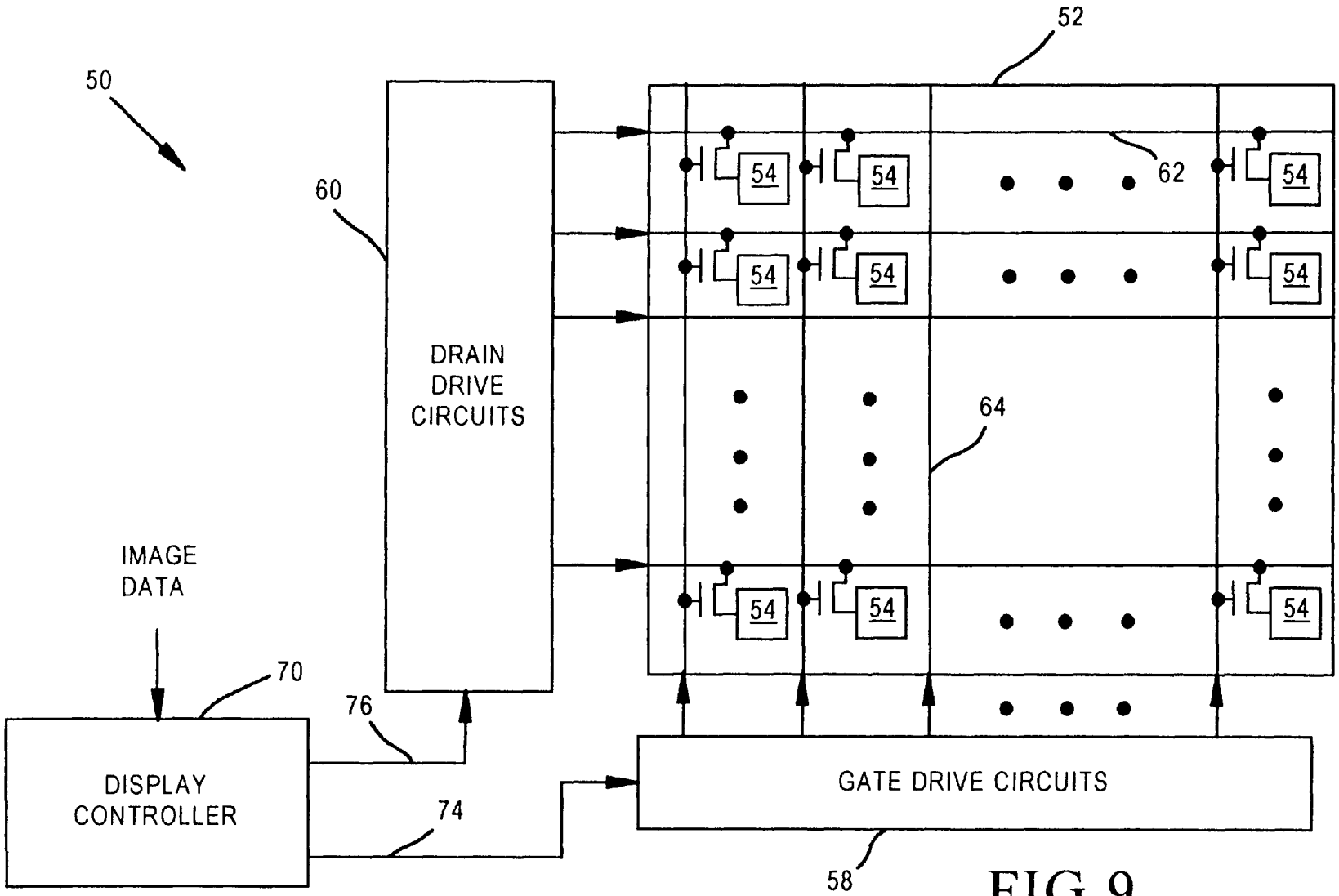
FIG. 9 is a block diagram of an active matrix LCD display.

FIG. 9 shows a thin film transistor LCD panel 50 including an array 52 of pixel areas 54. Each pixel area 54 is formed as an area of liquid crystal material. Each pixel area 54 is electrically coupled to a thin film transistor (TFT) 56 at either one of the transistor's drain or source. In the illustrated embodiment the pixel areas are coupled to the transistor source. The array 52 also includes a pattern of row electrodes 62 and column electrodes 64. Each row electrode 62 is coupled to the drain of each TFT 56 in a given row of the array 52. Each column electrode is coupled to the gate of each TFT 56 in a given column of the array 52. Drain drive circuits 60 are coupled to the row electrodes 62. Gate drive circuits are coupled to the column electrodes 64. One of ordinary skill in the art will appreciate that the TFTs 56 can be wired in a different manner so that the row electrodes are coupled to the TFT gates and the column electrodes 64 are coupled to one of either the TFT drains or sources.

To activate a given pixel area 54, its corresponding TFT switch 56 is addressed by a signal from a gate drive circuit 58. Such signal is output along the row electrode 62 for such TFT switch 56. The optical state of the addressed pixel area 54 then is defined by the logic state of a signal received at the TFT drain from a drain drive circuit 60. Such logic state defining signal is output along the column electrode 64 for such TFT switch 56. For a monochromatic display panel each pixel "on" state is of the same color. For a color panel there are different colored pixel areas 54 (e.g., red, green and blue).

The state of the logic state defining signal is determined from an image signal received at a timing controller 70. The timing controller 70 controls the output of such image data to the appropriate gate drive circuit 58 so as to define the desired state of each pixel area 54 in the display panel array 52. Timing signals 74, 76 are sent from the timing controller 70 to the gate drive circuits 58 and drain drive circuits 60 which determine the addressing sequence for activating the various pixel areas 54.

The TFT switches 56 are more densely packed for higher resolution displays. The more densely the TFT switches 56 are packed the higher the probability of unintended coupling between adjacent circuits. In particular, gate drive pulses along a row electrode 62 can couple to a column electrode 64 and drain contact of a TFT switch 56, directly affecting the TFT state, and correspondingly, the gray scale of a corresponding pixel area 54. In the illustrated embodiment, the degree of coupling is dependent on the signal on the column electrode 64. Thus, the degree of gray shift is data-dependent. Because the coupling between adjacent TFT panel circuits is through a parasitic capacitance, the coupling gets worse at higher frequencies. The rectangular pulses used for the row line selects have significant harmonic content. It is the high frequency energy from the harmonics of the edges which causes the most problems.

FIG. 2 shows a raised cosine waveform 32 which is used to drive the TFT switches. FIG. 3 shows an ideal rectangular drive pulse frequency spectrum 34. FIG. 4 shows an actual rectangular drive pulse frequency spectrum 36 exhibiting parasitic coupling effects as described above. FIG. 5 shows the actual logic state defining waveform 37 intended to be a rectangular wave. Note that the pulses are distorted to exhibit an exponential transition 38, rather than a sharp transition 40 as in the ideal rectangular waveform 30 of FIG. 2. The raised cosine pulses or rectangular pulses serve as alternate embodiments for a row drive pulse.

FIG. 6 shows the ideal raised cosine drive pulse frequency spectrum 44. FIG. 7 shows the actual raised cosine drive pulse frequency spectrum 46 exhibiting the parasitic coupling effects. FIG. 8 shows the actual raised cosine drive signal 48 received by the column electrodes 64 in the presence of such parasitic coupling. Note that the effect is merely a slight phase shift and decrease in amplitude. The amplitude degradations are readily correctable using a variable gain amplifier, while the phase shifts are correctable using a phase shift at a phased locked loop circuit.

Figure 10:
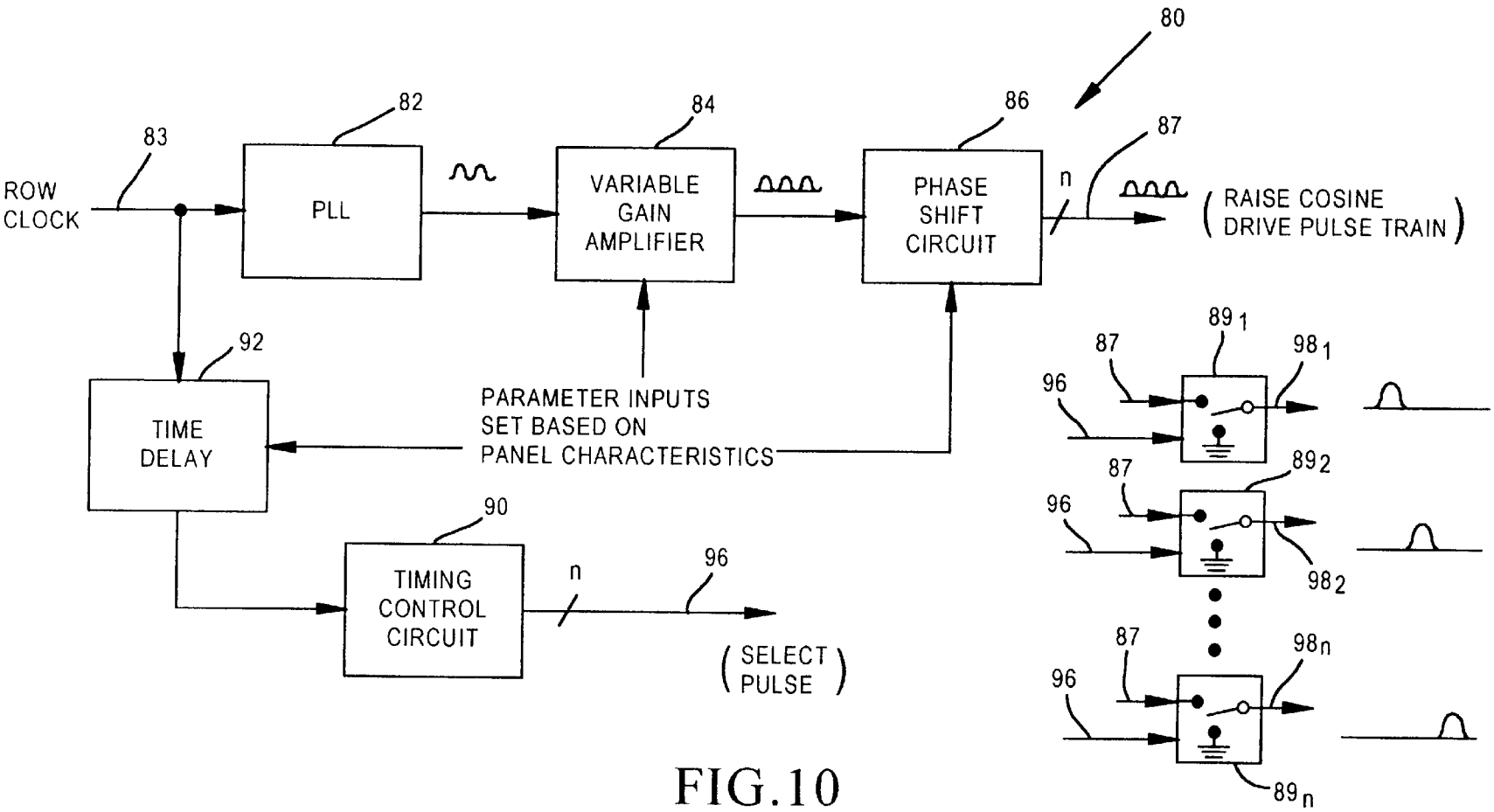
FIG. 10 is a block diagram of a circuit for generating raised cosine pulses according to an embodiment of this invention.

FIG. 10 shows a circuit 80 for generating row select pulses (i.e., raised cosine drive pulses) for the active matrix panel 52 of FIG. 9 (and the passive matrix panel 12 of FIG. 1). Circuit 80 is part of the drive circuitry 60 of FIG. 9 (and circuitry 24 of FIG. 1). The circuit 80 generates a raised cosine wave signal 87 and several row select pulse signals 96. There is one row select pulse signal 96 for each row of the panel. The raised cosine signal 87 goes to a switch 89 for each row. Normally the switch of a row 89 is set to output a prescribed dc voltage (e.g., a ground signal). When the row select pulse 96 for such row is active, however, the switch instead passes the raised cosine wave 87. The signal 96 is synchronized to pass one pulse 98 of the raised cosine signal 87 to the selected row. Each row in turn is selected and receives a raised cosine pulse.

The raised cosine signal 87 is derived from a row clock signal 83 which is fed into a phase locked loop (PLL) circuit 82. The PLL output is fed into a variable gain amplifier 84, then a phase shift circuit 86. The raised cosine signal 87 is output from the phase shift circuit 86. The row select pulses 96 are also derived from the row clock signal 83. The row clock signal 83 is fed into a time delay circuit 92, then a timing control circuit 90. The timing control circuit generates the select pulses 96 for each of the respective rows. For the select pulses 96 to properly pass a raised cosine pulse at the corresponding switch 89, the phase shift of the phase shift circuit 86 is synchronized with the time delay of the time delay circuit 92. The specific phase shift of the phase shift circuit 86, time delay of the time delay circuit 92 and gain of the variable gain amplifier 84 are prescribed for a given panel based upon such panel's characteristics. More specifically, such phase shift, delay and gain are selected to correct for the adverse low pass filtering effects of the panel. Once set for a given panel such values typically do not need to be changed.

Accordingly, crosstalk effects and signal degradation can be avoided in an active matrix display by using drive signals formed of raised cosine pulses. The better performance of the raised cosine pulses is due to the presence of many fewer harmonics in the raised cosine pulse frequency spectrum compared to the rectangular pulse frequency spectrum and the frequency spectrums of more complex signals now being used as drive signals.

Figure 11:
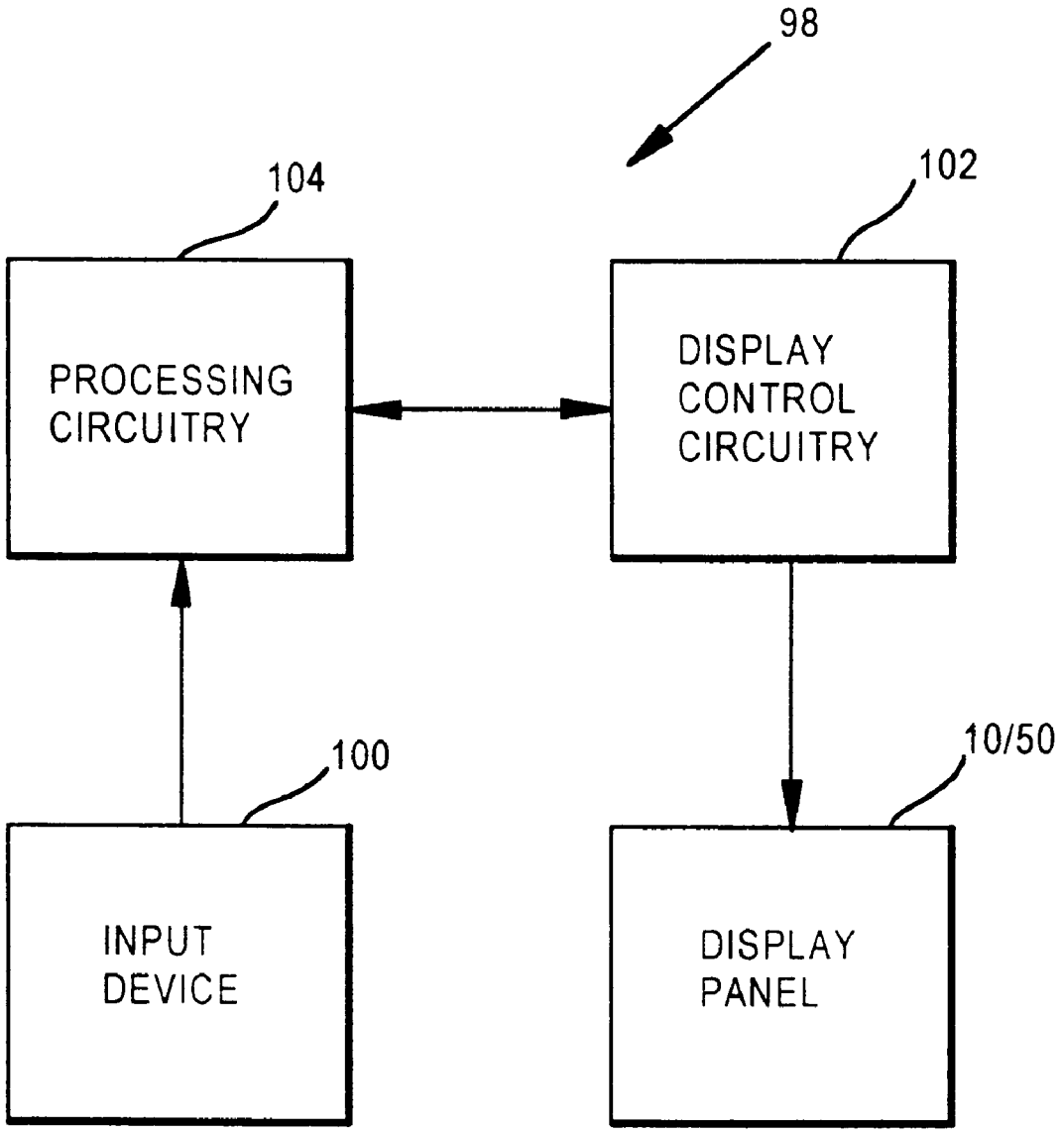
FIG. 11 is a block diagram of an electronic device including the display panel of FIG. 1 or FIG. 9.

Preferably, the super twist nematic LCD panel 10 of FIG. 1 or the thin film transistor LCD panel 50 of FIG. 9 are part of an electronic device. Referring to FIG. 11, an electronic device 98 includes the display panel 10/50. In various embodiments the electronic device is a desktop, portable or hand held computer, a television set, a visual gaming device (e.g., video game device; arcade game device), or another electronic apparatus for viewing an image. The electronic device 98 includes an input device 100 such as a button, keyboard, pointing device, along with display control circuitry 102, along with additional processing and or communication circuitry 104 for generating or otherwise rendering images to be displayed on the panel 10/50.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. A liquid crystal display apparatus, comprising:

a plurality of pixel cell areas organized into a matrix of rows and columns, each one row of pixel cell areas having a common row drive line on which is received a common row drive signal, the matrix receiving a plurality of row drive signals, each column of pixel cell areas having a common column drive line on which is received a common column drive signal, wherein the row drive signal of not more than one row in the matrix is active at a given time; and wherein the row drive signal which is active comprises a plurality of pulses, said pulses being of a raised cosine shape which minimizes visible crosstalk distortion on the display apparatus due to minimal harmonic content.

2. The display apparatus of claim 1, further comprising a thin film drive transistor for each pixel cell area of the plurality of pixel cell areas, wherein the row drive signal for a given pixel cell area is received at the corresponding drive transistor, and wherein the raised cosine shape of said pulses in the row drive signal received at said corresponding drive transistor minimizes coupling between adjacent row drive lines.

3. The display apparatus of claim 1, further comprising a super twist nematic connection for each pixel cell area of the plurality of pixel cell areas, wherein the row drive signal for a given pixel cell area is received at the corresponding connection, and wherein the raised cosine shape of said pulses in the row drive signal received at said corresponding connection exhibit minimal harmonics so as to be less susceptible to degradation and corresponding crosstalk distortion.

4. The display apparatus of claim 1, further comprising:

a circuit which generates the plurality of row drive signals, said circuit including an amplifier which has a gain which compensates for amplitude degradation in the row drive signals attributable to low pass filtering effects of the matrix, and a phase shift circuit which has a phase shift which compensates for phase shifting in the row drive signals attributable to low pass filtering effects of the matrix.

5. An electronic apparatus, comprising:

a circuit which generates an image signal;

a liquid crystal display which receives the image signal and which, in response, displays an image, the liquid crystal display comprising:

a plurality of pixel cell areas organized into a matrix of rows and columns, each one row of pixel cell areas having a common row drive line on which is received a common row drive signal, the matrix receiving a plurality of row drive signals, each column of pixel cell areas having a common column drive line on which is received a common column drive signal, wherein the row drive signal of not more than one row in the matrix is active at a given time; and wherein the row drive signal which is active comprises a plurality of pulses, said pulses being of a raised cosine shape which minimizes visible crosstalk distortion on the display apparatus due to minimal harmonic content.

6. The apparatus of claim 5, which is a television device, and wherein the image signal is a television image signal.

7. The apparatus of claim 5, which is a computer and further comprising an input device.

8. The apparatus of claim 5, which is a gaming system and further comprising an input device.

9. The display apparatus of claim 5, further comprising a thin film drive transistor for each pixel cell area of the plurality of pixel cell areas, wherein the row drive signal for a given pixel cell area is received at the corresponding drive transistor, and wherein the raised cosine shape of said pulses in the row drive signal received at said corresponding drive transistor minimizes coupling between adjacent row drive lines.

10. The display apparatus of claim 5, further comprising a super twist nematic connection for each pixel cell area of the plurality of pixel cell areas, wherein the row drive signal for a given pixel cell area is received at the corresponding connection, and wherein the raised cosine shape of said pulses in the row drive signal received at said corresponding connection exhibit minimal harmonics so as to be less susceptible to degradation and corresponding crosstalk distortion.

11. The display apparatus of claim 5, further comprising:

a circuit which generates the plurality of row drive signals, said circuit including an amplifier which has a gain which compensates for amplitude degradation in the row drive signals attributable to low pass filtering effects of the matrix, and a phase shift circuit which has a phase shift which compensates for phase shifting in the row drive signals attributable to low pass filtering effects of the matrix.

* * * * *